United States Patent [19]

Cook et al.

[11] Patent Number: 4,921,459

[45] Date of Patent: May 1, 1990

[54] MULTICHARACTER DOLL

[76] Inventors: Bertha B. Cook, 18503 Nadal Dr., Southfield, Mich. 48075; Betty J. Smith, 22801 Timberline Rd., Southfield, Mich. 48034

[21] Appl. No.: 181,519

[22] Filed: Apr. 14, 1988

[51] Int. Cl.[5] ..... A63H 3/00

[52] U.S. Cl. ..... 446/321; 446/337

[58] Field of Search ..... 446/97, 99, 101, 321, 446/337, 391; 434/154, 157, 396, 433; D 21/149

[56] References Cited

U.S. PATENT DOCUMENTS

| | | | |
|---|---|---|---|
| 1,396,766 | 11/1921 | McClelland | 446/321 |
| 1,425,974 | 3/1924 | Kearney | 446/321 |

FOREIGN PATENT DOCUMENTS

| | | | |
|---|---|---|---|
| 154722 | 1/1954 | Australia | 446/321 |
| 619702 | 5/1961 | Canada | 446/321 |
| 280867 | 5/1952 | Fed. Rep. of Germany | 446/321 |

*Primary Examiner*—Robert A. Hafer
*Assistant Examiner*—Sam Rimell
*Attorney, Agent, or Firm*—Dykema Gossett

[57] ABSTRACT

A multicharacter doll has four simulated figures. Each figure includes a torso that extends radially from a central body portion to a head disposed at a free end. A garment covers the central body portion and drapes over three of the four simulated figures so that a single figure remains undraped and the other figures are hidden from view. Each figure has an appearance representative of a person from a culture different from a culture of a person represented by any of the other simulated figures, and each figure has a passport book attached to it, which passport book includes indicia giving information on the country and culture represented by the simulated figure to which the passbook is attached. A method of teaching includes steps of turning the multicharacter doll to present any of the four simulated figures, whereby when each figure is presented participants in a social studies are allowed to inspect the figure and the passport book while a teacher discussed the country or culture represented by the figure. A method of making the multicharacter doll includes steps of fashioning the figures and a skirt garment that accomodates four figures in a manner consistent with the multicharacter doll and the method of teaching with it.

5 Claims, 3 Drawing Sheets

MULTICHARACTER DOLL

FIELD OF THE INVENTION

The present invention relates generally to dolls and more particularly to multipersonality or multicharacter dolls. Still more particularly, the present invention relates to a multicharacter doll that has a integral body formed of a plurality of simulated figures each figure having a physical manifestation of a single personality or character.

BACKGROUND OF THE INVENTION

A doll manifesting more than one character is a convenient equivalent to having more than one doll. A child, for example, would find it more convenient to carry around one doll than to transport a number of dolls. Yet a child becomes bored with the appearance of one doll, particularly a child skipping about his or her fantasies, so that a multicharacter doll provides relief from becoming bored with any one doll personality or character without the inconvenience of having to transport or store a number of dolls, each having a dirfferent personality or character.

Notwithstanding the expediency of multicharacter dolls as substitutes for pluralities of dolls, the popularity of multicharacter dolls is tracable to their stability for teaching and story telling. A single multiple personality or multicharacter doll provides a stage of actors, rather than a single actor, for carrying out a multicharacter plot. A multicharacter doll provides perspective for teaching about a number of character or personality traits which are evinced by facial expression or by clothing. Also, a multicharacter doll provides perspective for teaching about a number of cultures identified by the appearance and costuming of characters from those cultures. Again, convenience proves to be the significant advantage, so that the number of characters can exceed the number of teachers or story tellers without a teacher or story teller having to delay the flow of discourse by putting down one character to pick up another.

PRIOR ART

In most versions of multicharacter dolls, each such doll is limited to two characters. For example, U.S. Pat. No. 1,396,766 issued to McClelland on Nov. 15, 1921, describes a doll that is composed of two body members arranged in longitudinal alignment and integral with each other. The doll has skirt portions which form a continuation of a dress waist for each doll. The skirt portions are arranged within one another and secured together at their upper and lower ends so that they are, in essence, one reversible skirt. Thus, when one face and body member of the doll is exposed, as when the doll is held vertical so that the vertically depending skirt falls down from the dress waist over the other body member and face, the one exposed face and body appears as one personality. Another personality is displayed when the skirt is over the first mentioned one face and body member, as when the dolls orientation in the example is reversed.

U.S. Pat. No. 1,495,974 issued to Kearney teaches another version of multicharacter dolls limited to two characters. In the Kearney version, the doll has the frontal appearance of a character on each of the doll's opposing sides.

The disadvantage of the Kearney structure is that there is little one can do to disguise the fact that the characters have a back appearance that is inconsistent with the front appearance. Kearney gives the example of a multiracial doll, but the technique of using a pivoting head garment to hide one of the characters does little to disguise the body coloring from the rear of the other character being revealed. Moreover, the teaching of hiding the face of one of the chaaracters is even more limited when a range of costuming is desired.

One might assert that, to one of ordinary skill in the doll art, a combination of McClelland and Kearney may provide an obvious advantage of having four characters, but the advantage, which would be more particularly over McClelland, would nevertheless suffer from the limitations of Kearney. In this regard, two pairs of characters may be formed of two body members, each with a character on each body member's opposing sides and the two body members arranged integral with each other in longitudinal alignment. But such an arrangement, even if it were an obvious combination without a motivation as provided by the invention disclosed herein, would be as limited with regard to body coloring and costuming as is the Kearney doll.

OBJECTS OF THE INVENTION

Accordingly, it is one object of the present invention to provide a multicharacter doll that has more than two personalities, each of which may have coloring, costuming, and rear perspective that are different from the others.

It is another object of the present invention to provide a multicharacter doll that can have as many as four characters or personalities, each of which may have coloring, costuming, and rear perspective different from the others.

It is yet another object of the present invention to provide multicharacter doll that may have as many as four characters, each having a different ethnic, cultural, and racial appearance.

Yet still another object of the present invention is to provide a multicharacter doll which has four characters each having a different ethnic, cultural, and/or racial appearance and each of which has a front and back appearance.

Furthermore, it is an object of the present invention to provide a multicharacter doll that does not suggest that there are as many as four characters to be revealed by it.

Still further, it is an object of the present invention to provide a multicharacter doll that has a skirt structured so that the doll is not limited to two characters.

And further, it is an object of the present invention to provide a multicharacter doll that has a skirt which is structured so that the doll may have as many as four characters, three of which are unrevealed.

In furtherance of the just-disclosed object of the present invention, it is another object to provide a multicharacter doll that may be used to teach with or as a focus for story telling, whereby participants may inspect a character revealed without being detracted by different, nonconforming appearances of other characters, in particular, characters that may be different as between the front and back of the doll.

In furtherance of all of the above-disclosed objects, it is an object of the present invention to provide a method of making a multicharacter doll in a skir garment that is adapted to reveal, each at a time, one of four different figures, while hiding the others.

A related object of the invention is to provide a method of teaching by utilizing the advantages of a four figure, multicharacter doll.

SUMMARY OF THE INVENTION

These and other objects are accomplished in the present invention by a multicharacter doll that is structured to have a central body portion with at least three simulated figures. Each simulated figure includes a head and a torso which extends radially from the central body portion in spoke-like retationship to other torsos. The doll also has a garment that covers the central body portion and drapes over several simulated figures so as to hide them from view, while one figure remains undraped with the garment appearing as the skirt of the one figure.

Preferably, the multicharacter doll has four simulated figures. It is also preferable that any one of the four simulated figures has an appearance representative of a person from a culture different from a culture of a person represented by another of the four simulated figures. In such an embodiment, it is preferred that a passport book be attached to each of the four simulated figures. The passport book would include indicia giving information on the culture represented by the simulated figure to which the passbook is attached.

The spoke-like relationship of each torso to each other torso is such that each torso is angularly adjacent to two other torsos, the first said torso extending from the central body portion between the two other torsos. In one preferred embodiment, a skirt is draped around each torso. The torso has a waist and the skirt has a top and a bottom oriented so that the top is gathered around the waist. One half of the bottom of each skirt is joined along a generally semicircular segment to one half of the bottom of a skirt draped around one of the two angularly adjacent torsos. The other half of the bottom of each skirt is joined along a generally semicircular segment to one half of the bottom of the skirt draped around the other of the two angularly adjacent torsos. A method is disclosed for making such an overall garment comprising the skirts for each torso.

Other methods of making the garment are disclosed. In one of these other methods, each of two sheets of material is provided with an opening generally through its center and each sheet is folded in half diametrically through the opening. As a result, each folded sheet has a first panel and a second panel with an edge fold and crease between them, the edge fold being exposed and the crease being the inside of the edge fold. The edge folds of the at least two sheets are united so that the first panels of two sheets form together a first sheet side. Each sheet side is accordingly the size of one sheet unfolded, and also accordingly, the second panels of the two sheets form together a third sheet side. One of the sheets unfolded forms a second sheet side that is angularly between the first and third sheet sides, and the other sheet unfolded forms a fourth sheet side. Thus, each sheet side has an opening through which a respective torso can extend. Each torso is slipped through an opening and the material gathered around each opening is attached to the respective torso extending through the opening. Boundary material of each sheet side may be cut away to leave a generally circular sheet of material which, when one figure is held upwardly relative to the acceleration of gravity, falls into a skirt over several of the figures so as to hide them.

In yet another method of making the garment, two sheets of material are again used. Each sheet being bounded by two opposite edges is folded over so that the sheet is in two folded sections. Each folded section is then reverse folded to leave the sheet with two outside panels bounding a pair of inside panels in a zig zag edge formation. With this arrangement, each of the two opposite edges of one of the two sheets is united with each of the two opposite edges of the other of the at least two sheets. Each united pair of outside panels form together first and third sheet sides, each sheet side being the size of one sheet section unfolded, and a second sheet side and a fourth sheet side are respectively the pair of inside panels unfolded. An opening is formed generally through the center of each sheet side for a torso to extend through. The material around each opening is gathered and attached to the respective torso extending through it, and the boundary material of each sheet side is cut away to leave a generally circular sheet of material which, when one figure is held upwardly relative to the acceleration of gravity, falls into a skirt over several of the figures so as to hide them.

A method of teaching social studies by advantageously using the multicharacter doll in accordance with the present invention is disclosed. The method involves a step of presenting one of four simulated figures of the multicharacter doll, each figure including a torso extending radially from a central body portion to a head disposed at a free end and a garment covering the central body portion and draping over three of the four simulated figures so that a single figure remains undraped and the other figures are hidden from view. Each figure has an appearance representative of a person from a culture different from a culture of a person represented by any of the other simulated figures, and each figure has a passport attached to it. The passport book includes indicia giving information on the country and culture represented by the simulated figure to which the passbook is attached.

Another step involves turning the multicharacter doll to present another of the four simulated figures. Further steps involve presenting each of the other four simulated figures. When each figure is presented, participants in the social studies are allowed to inspect the figure and the passport book while a teacher discusses the country or culture represented by the figure.

BRIEF DESCRIPTION OF THE DRAWINGS

A better understanding of the invention will be had by now referring to a preferred embodiment thereof as illustrated in the accompanying drawings in which.

DESCRIPTION OF THE PREFERRED EMBODIMENT

Figure 1:
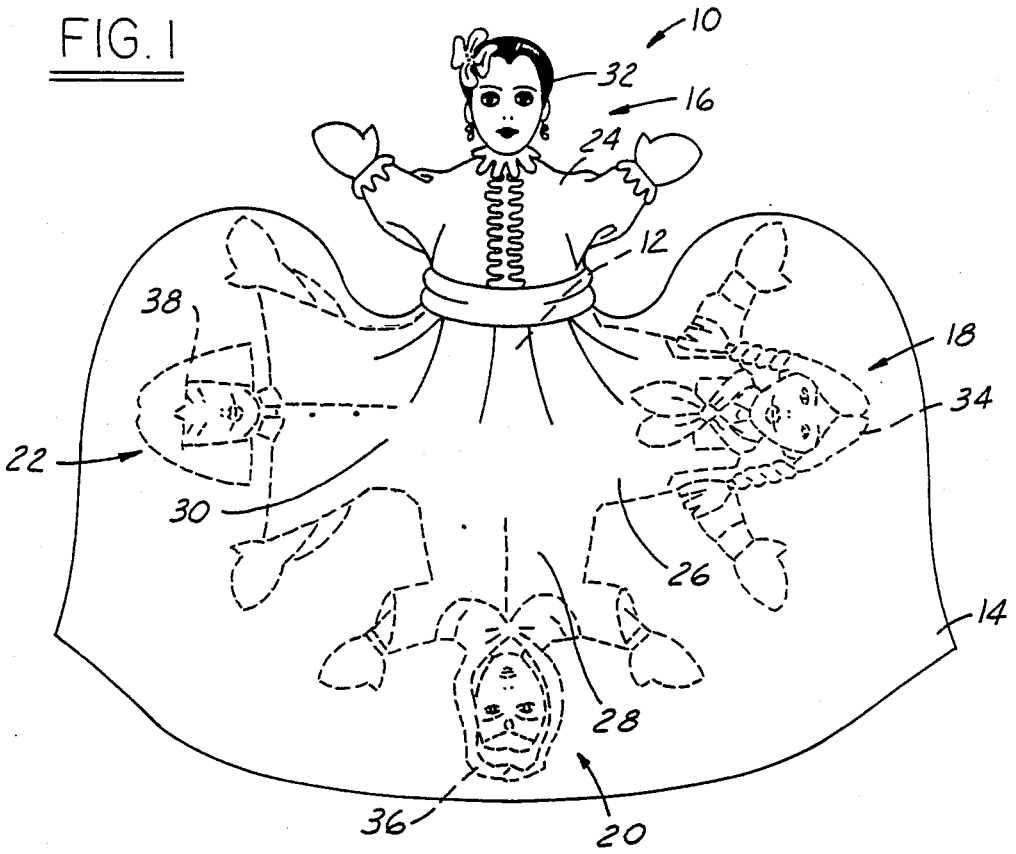
FIG. 1 is a front elevational view of a multicharacter doll in accordance with the present invention, showing one of the figures revealed, with the others shown in phantom beneath a skirt garment.
Figure 2:
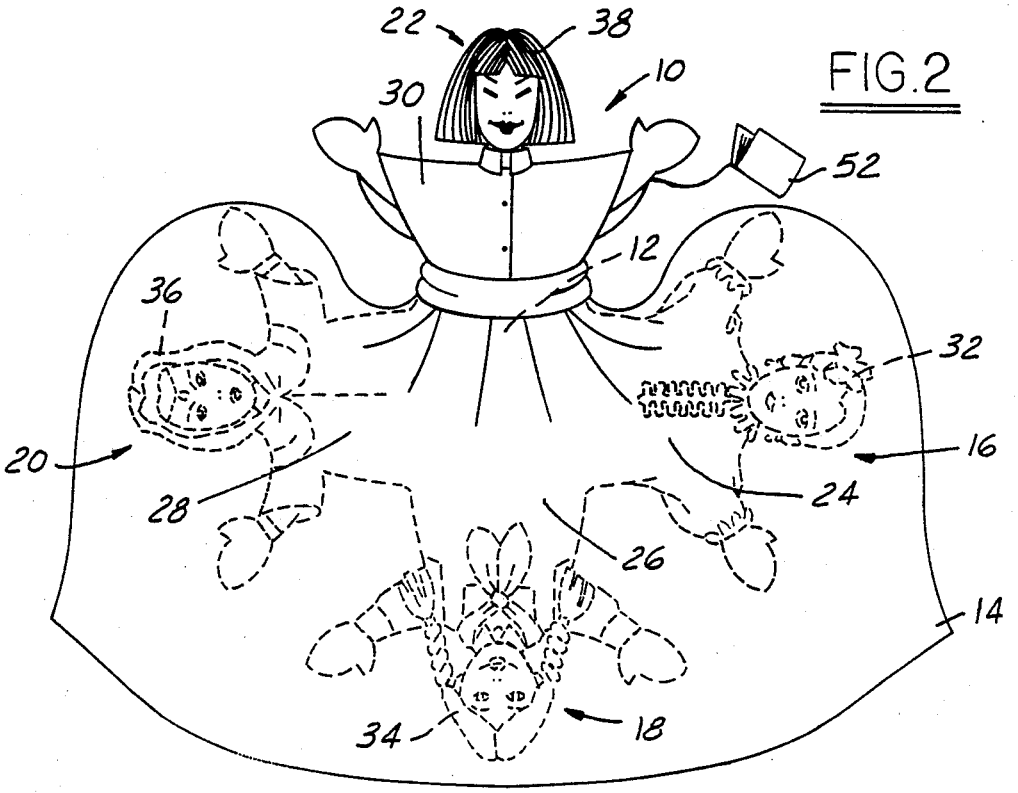
FIG. 2 is another front elevational view of a multicharacter doll in accordance with the present invention showing another of the figures revealed, with the figure of FIG. 1 in phantom as it is now beneath the skirt garment with other figures.
Figure 3:
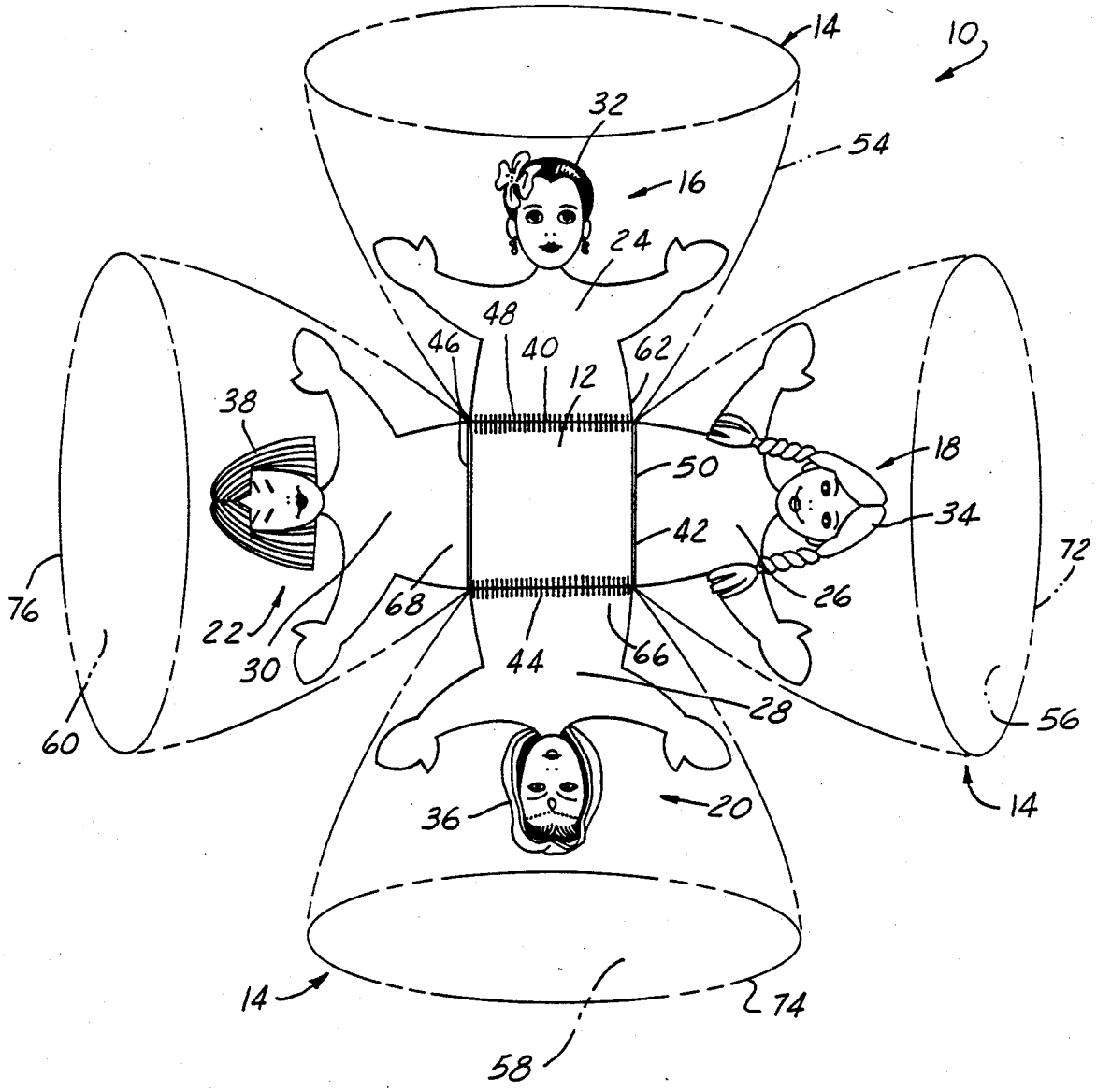
FIG. 3 is a front elevational view of the dolls undressed, illustrating skirts on the dolls in phantom to show a step in a first method of making a garment comprised of the skirts of each of the figures shown in FIG. 1 and FIG. 2.

Referring now to the drawings more in detail, particularly FIGS. 1, 2 and 3, a multicharacter doll is designated generally at 10. The doll 10 is structured to have a central body portion 12, which is hidden beneath a skirt garment 14 in FIGS. 1 and 2, but revealed in FIG. 3.

At least three simulated human figures, preferably four simulated human figures 16, 18, 20 and 22, extend radially from the central body portion 12. As can be seen with particularly in FIG. 3, the simulated human figures 16, 18, 20 and 22 extend in a spoke-like retationship with respect to one another.

Simulated human figures 16, 18, 20 and 22 include torsos 24, 26, 28 and 30, respectively, each torso having arms attached to fully simulate an upper portion of a human torso. Attached to free ends of torsos 24, 26, 28 and 30, opposite the central body portion 12 to which torsos 24, 26, 28 and 30 are attached and from which torsos 24, 26, 28 and 30 extend, are respective heads 32, 34, 36 and 38.

At the attachment of torsos 24, 26, 28 and 30 are waists 40, 42, 44 and 46, as can be seen with particularly in FIG. 3. If the torsos 24, 26, 28 and 30 are made of cloth, the waists are formed either by the attachment of a torso to the central body portion, for example by stitches which form stitching 48 between torso 24 and central body portion 12, or by a string or cord 50 drawn around the integral union of the central body portion and the torso, as string or cord 50 is drawn around the integral union of the central body portion 12 and torso 26.

It is to be appreciated that heads 32, 34, 36 and 38 may be fashioned in a variety of ways to suggest a number of characters each attributable to a particular head 32, 34, 36 or 38. As an example, in FIGS. 1, 2 and 3 the heads of the doll are fashioned to suggest that they come from different countries with different cultures and races. According to the example, head 32 suggests that the character of the simulated figure is Spanish, while head 38 suggests that the character of the simulated human figure 22 is Chinese. To complete the characterization, torsos 24, 26, 28 and 30 are dressed in shirtwaists to characterize the cultural dress of the simulated figures 16, 18, 20 and 22.

As an optional feature, a passport may be attached to each of the four simulated human figures 16, 18, 20 and 22, as passbook 52 is shown in FIG. 2 attached to simulated human figure 22. The passport 52 includes indicia giving information on the culture represented by the simulated human figure to which the passbook is attached, in the example, simulated human figure 22.

The spoke-like relationship of each torso 24, 26, 28, 30 to each other torso 24, 26, 28, 30 results in each torso 24, 26, 28, 30 being angularly adjacent two other torsos, as for example torso 26 is angularly adjacent torsos 24 and 28 as it extends between them from the central body portion 12.

With reference to FIG. 3, a first method will now be explained for making the skirt garment 14 (see FIGS. 1 and 2) for doll 10 which hides the unrevealed simulated human figures, as for example simulated human figures 18, 20 and 22 when simulated human figure 16 is revealed. Skirt garment 14 comprises skirts 54, 56, 58 and 60 which are draped around torsos 24, 26, 28, 30, respectively. Skirts 54, 56, 58 and 60 have respective tops 62, 64, 66 and 68 and bottoms 70, 72, 74 and 76 oriented so that the top 62, 64, 66 and 68 are gathered around waists 40, 42, 44 and 46. One half of bottom 70 of skirt 54 is joined along a generally semicircular segment to one half of the bottom 72 of skirt 56. The other half of bottom 70 of skirt 54 is joined along a generally semicircular segment to one half of the bottom 76 of skirt 60. The other half of bottom 72 of skirt 56 is joined along a generally semicircular segment to one half of the bottom 74 of skirt 58. Finally, the other half of bottom 74 of skirt 58 is joined along a generally semicircular segment to the remaining half of the bottom 76 of skirt 60.

Figure 4:
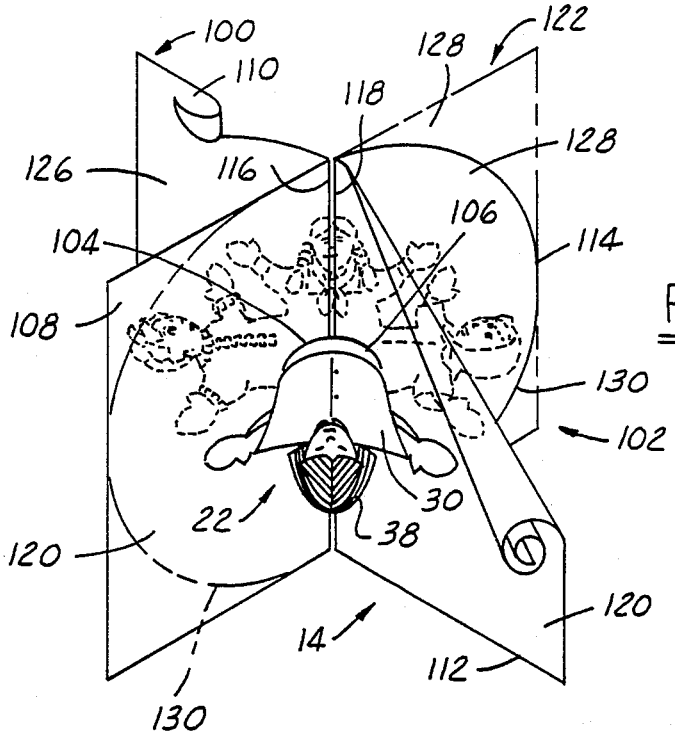
FIG. 4 is a perspective illustrating a second method of making a garment comprised of the skirts of each of the figures shown in FIG. 1 and FIG. 2.

A second method of making the skirt garment 14 (see FIGS. 1 and 2) requires reference to FIG. 4. Two sheets of material 100 and 102 are provided with respective openings 104 and 106 generally through their centers. Both sheets 100 and 102 are folded in half, diametrically through the openings 104 and 106. As a result, folded sheets 100 and 102 have respective first panels 108 and 110 and respective second panels 112 and 114. Respective edge folds 116 and 118 and creases are disposed the respective panels, the edge folds 116 and 118 being exposed and the crease being the inside of the edge folds 116 and 118.

The edge folds 116 and 118 are united so that the first panels 108 and 112 form together a first sheet side 120. Each sheet side is accordingly the size of one sheet 100 or 102 unfolded, and also accordingly, the second panels 110 and 114 form together a third sheet side 122. Sheet 102 unfolded forms a second sheet side 124 that is angularly between the first sheet side 120 and the third sheet side 122. Sheet 100 unfolded forms a fourth sheet side 126. Thus, each sheet side has an opening through which a respective torso 24, 26, 28 and 30 can extend. Each torso 24, 26, 28 or 30 is slipped through an opening and the material gathered around each opening is attached to the torso 24, 26, 28 or 30 extending therethrough. Boundary material 128 of each sheet side may be cut away to leave a generally circular sheet of material 130 which, when one figure, for example figure 16 in FIG. 1 is held upwardly relative to the acceleration of gravity, falls into the skirt garment 14 over several of the figures 18, 20 and 22 so as to hide them.

Figure 5:
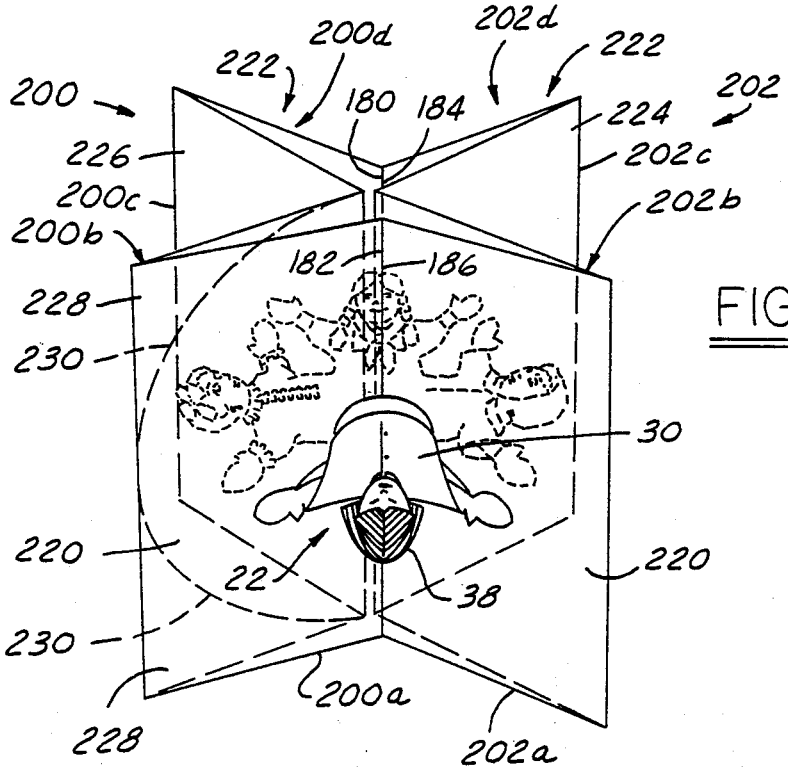
FIG. 5 is a perspective illustrating a third method of making a garment comprised of the skirts of each of the figures shown in FIG. 1 and FIG. 2.

In yet a third method of making the garment 14 (see FIGS. 1 and 2), reference is now being made to FIG. 5. Preferably two sheets of material 200 and 202 are again used, although it should be appreciated by those skilled in the art that one elongated sheet, extending the length of sheet 202 added to the length of sheet 200 and folded so as to be the equivalent of two sheets 200 and 202, may be used instead. Sheet 200 is bounded by two opposite edges 180 and 182 and sheet 202 is bounded by two opposite edges 184 and 186. Both sheets 200 and 202 are folded over so that each sheet 200 or 202 is in two folded sections. Each folded section is then reverse folded to leave the sheet 200 or 202 with two outside panels **200*a* and 200*d* for sheet 200 and 202*a* and 202*d* for sheet 202. The outside panels bound a pair of inside panels 200*b* and 200*c* for sheet 200 and 202*b* and 202*c* for sheet 202. With this arrangement, two opposite edges 180 and 182 of sheet 200 and two opposite edges 184** and 186 of sheet 202 are united by known means of uniting material, as for example by stitching the sheets together.

As an aside, to allow one of ordinary skill in the art to fully appreciate the scope of the invention, it is to be appreciated that if one elongated sheet had been folded so as to be the equivalent of two sheets 200 and 202, as has been suggested above, the arrangement would be without one pair of edges to unite because the sheets 200 and 202 would be integrally united. Although this is not the preferred arrangement, the definition of "sheet" and "arrangement" as used in this specification and in the claim language nevertheless contemplates such an arrangement. Other arrangements, such as a continuous loop weaved onto a mandrel with both pairs of edges thereby being integrally united, are also contemplated as equivalent.

To continue with the preferred third method, the united pairs of outside panels form together a first side 220 and a third sheet side 222. Sheet sides 220 and 222 are each the size of one sheet section unfolded. A second sheet side 224 and a fourth sheet side 226 are respectively the pair of inside panels 202*b* and 202*c* for sheet 202 and 200*b* and 200*c* for sheet 200 unfolded. An opening is formed generally through the center of each sheet side 220, 222, 224 or 226 for a torso 24, 26, 28 or 30 to extend through. The material around each opening is gathered and attached to the respective torso 24, 26, 28 or 30 extending through it. The boundary material 228 of each sheet side 220, 222, 224 or 226 may be cut away to leave a generally circular sheet of material 230 which, when one figure, again the example of figure 16 in FIG. 1 is used, is held upwardly relative to the accelleration of gravity, falls into a skirt garment 14 over several of the figures 18, 20 and 22 so as to hide them.

A method of teaching social studies by advantageously using the multicharacter doll in accordance with the present invention involves a step of presenting one of four simulated figures 16, 18, 20 and 22 of the multicharacter doll 10 in FIG. 2, for example simulated human figure 22. Each figure has a passport attached to it, as for example passbook 52 attached to figure 22 in FIG. 2. The passport 52 includes indicia giving information on the country and culture represented by the simulated figure 22 to which the passbook 52 is attached which may be inspected by participants in the social studies class employing the method of teaching that is the present invention.

Another step involves turning the multicharacter doll 10 to present another of the four simulated figures, for example simulated human figure 16. Further steps involve presenting each of the other four simulated figures 18 and 20. When each figure is presented, participants in the social studies are allowed to inspect the figure and the passport book while a teacher discusses the country or culture represented by the figure.

It will be understood that various modifications may be made to the assembly and the method of using it without departing from the purview of the appended claims.

We claim:

1. A doll comprising:

a central body portion;

at least three simulated figures, each figure including a head and a torso, each torso extending radially from the central body portion to a free end, each head being disposed at said free end, each torso extending between first and second adjacent torsos; and a skirt garment covering the central body portion including a plurality of skirts extending from the central body portion and being capable of draping over several simulated figures so that a single figure remains undraped and all other figures are hidden from view.

2. The doll of claim 1 wherein the skirt garment includes a plurality of skirts, each skirt having a top and a bottom, the bottom generally defining a circle, the top of each skirt being gathered around a respective torso, including the first and second adjacent torsos, and each skirt depending therefrom to the bottom, generally one half of the circle defined by the bottom of said each skirt being attached to one-half of the circle defined by the bottom of the skirt gathered around the first adjacent torso and generally the other half of the circle defined by the bottom said each skirt being attached to one-half of the circle defined by the bottom of each skirt gathered around the second adjacent torso.

3. The doll of claim 1 wherein the doll includes four simulated figures.

4. The doll of claim 3 wherein each of the four simulated figures has facial indicia.

5. The doll of claim 4 wherein a passport book is attached to at least one of the four simulated figures, the passport book including indicia.

* * * * *